US007898512B2

(12) United States Patent
Kurumisawa et al.

(10) Patent No.: US 7,898,512 B2
(45) Date of Patent: Mar. 1, 2011

(54) IMAGE DISPLAY DEVICE AND ELECTRONIC APPARATUS

(75) Inventors: Takashi Kurumisawa, Shiojiri (JP); Yusuke Okazaki, Tottori (JP)

(73) Assignee: Epson Imaging Devices Corporation, Azumino-shi (JP)

( * ) Notice: Subject to any disclaimer, the term of this patent is extended or adjusted under 35 U.S.C. 154(b) by 770 days.

(21) Appl. No.: 11/979,706

(22) Filed: Nov. 7, 2007

(65) Prior Publication Data

US 2008/0198095 A1 Aug. 21, 2008

(30) Foreign Application Priority Data

Feb. 20, 2007 (JP) ..... 2007-038911

(51) Int. Cl.
*G09G 3/36* (2006.01)

(52) U.S. Cl. ..... 345/84; 348/42; 345/87

(58) Field of Classification Search ..... 345/7, 345/8, 9, 84–107; 348/51, 60
See application file for complete search history.

(56) References Cited

U.S. PATENT DOCUMENTS

| | | | | |
|---|---|---|---|---|
| 7,567,222 | B2 * | 7/2009 | Tanaka et al. | 345/7 |
| 7,580,186 | B2 * | 8/2009 | Mather et al. | 359/463 |
| 7,623,111 | B2 * | 11/2009 | Ioki et al. | 345/102 |
| 2007/0296865 | A1 | 12/2007 | Mino et al. | |

FOREIGN PATENT DOCUMENTS

| | | |
|---|---|---|
| JP | A 08-331605 | 12/1996 |
| JP | A 09-074574 | 3/1997 |
| JP | B2 3096613 | 8/2000 |
| JP | A 2004-140700 | 5/2004 |
| JP | A 2004-207772 | 7/2004 |
| JP | A 2004-302270 | 10/2004 |
| JP | A-2006-154756 | 6/2006 |
| JP | A 2006-276569 | 10/2006 |

* cited by examiner

*Primary Examiner*—Richard Hjerpe
*Assistant Examiner*—Sepideh Ghafari
(74) *Attorney, Agent, or Firm*—Oliff & Berridge PLC

(57) ABSTRACT

An image display device includes a display panel having a plurality of pixel display portions arranged in a longitudinal direction and a lateral direction thereof, a plurality of slits arranged on the display panel so as to correspond to spaces between the pixel display portions adjacent to each other, an image input unit acquiring a first input image and a second input image, and a display control portion displaying the first input image and the second input image by alternately imparting input pixel data of the first input image and input pixel data of the second input image to the plurality of pixel display portions in the longitudinal direction and the lateral direction, in which the display control portion prepares display pixel data corresponding to specific input pixel data on the basis of the specific input pixel data of each of the first input image and second input image and at least one neighboring input pixel data adjacent to the specific input pixel data in the longitudinal direction or the lateral direction in the corresponding input image using a predetermined synthesis coefficient.

7 Claims, 9 Drawing Sheets

FIG. 5

<FIRST RENDERING METHOD>

(RIGHT INPUT IMAGE)

| | | | | | |
|---|---|---|---|---|---|
| Ri 1R | Gi 1R | Bi 1R | Ri 2R | Gi 2R | Bi 2R |
| Ri 3R | Gi 3R | Bi 3R | Ri 4R | Gi 4R | Bi 4R |
| Ri 5R | Gi 5R | Bi 5R | Ri 6R | Gi 6R | Bi 6R |

(LEFT INPUT IMAGE)

| | | | | | |
|---|---|---|---|---|---|
| Ri 1L | Gi 1L | Bi 1L | Ri 2L | Gi 2L | Bi 2L |
| Ri 3L | Gi 3L | Bi 3L | Ri 4L | Gi 4L | Bi 4L |
| Ri 5L | Gi 5L | Bi 5L | Ri 6L | Gi 6L | Bi 6L |

(DISPLAY IMAGE)

| | | | | | |
|---|---|---|---|---|---|
| Ro 1R | Go 1L | Bo 1R | Ro 2L | Go 2R | Bo 2L |
| Ro 3L | Go 3R | Bo 3L | Ro 4R | Go 4L | Bo 4R |
| Ro 5R | Go 5L | Bo 5R | Ro 6L | Go 6R | Bo 6L |

⟨CENTRAL PORTION PROCESSING (Ro3L TO Bo4R)⟩

$$\left.\begin{aligned}
Ro3L &= (1-\alpha)Ri3L+\alpha(Ri1L+Ri5L)/2\\
Go3R &= (1-\alpha)Gi3R+\alpha(Gi1R+Gi5R)/2\\
Bo3L &= (1-\alpha)Bi3L+\alpha(Bi1L+Bi5L)/2\\
Ro4R &= (1-\alpha)Ri4R+\alpha(Ri2R+Ri6R)/2\\
Go4L &= (1-\alpha)Gi4L+\alpha(Gi2L+Gi6L)/2\\
Bo4R &= (1-\alpha)Bi4R+\alpha(Bi2L+Bi6L)/2
\end{aligned}\right\}(1-1)$$

⟨EDGE PROCESSING (Ro1R TO Bo2L)⟩

$$\left.\begin{aligned}
Ro1R &= (1-\alpha)Ri1R+\alpha(Ri3R)\\
Go1L &= (1-\alpha)Gi1L+\alpha(Gi3L)\\
Bo1R &= (1-\alpha)Bi1R+\alpha(Bi3R)\\
Ro2L &= (1-\alpha)Ri2L+\alpha(Ri4L)\\
Go2R &= (1-\alpha)Gi2R+\alpha(Gi4R)\\
Bo2L &= (1-\alpha)Bi2L+\alpha(Bi4L)
\end{aligned}\right\}(1-2)$$

⟨EDGE PROCESSING (Ro5R TO Bo6L)⟩

$$\left.\begin{aligned}
Ro5R &= (1-\alpha)Ri5R+\alpha(Ri3R)\\
Go5L &= (1-\alpha)Gi5L+\alpha(Gi3L)\\
Bo5R &= (1-\alpha)Bi5R+\alpha(Bi3R)\\
Ro6L &= (1-\alpha)Ri6L+\alpha(Ri4L)\\
Go6R &= (1-\alpha)Gi6R+\alpha(Gi4R)\\
Bo6L &= (1-\alpha)Bi6L+\alpha(Bi4L)
\end{aligned}\right\}(1-3)$$

FIG. 6

<SECOND RENDERING METHOD>

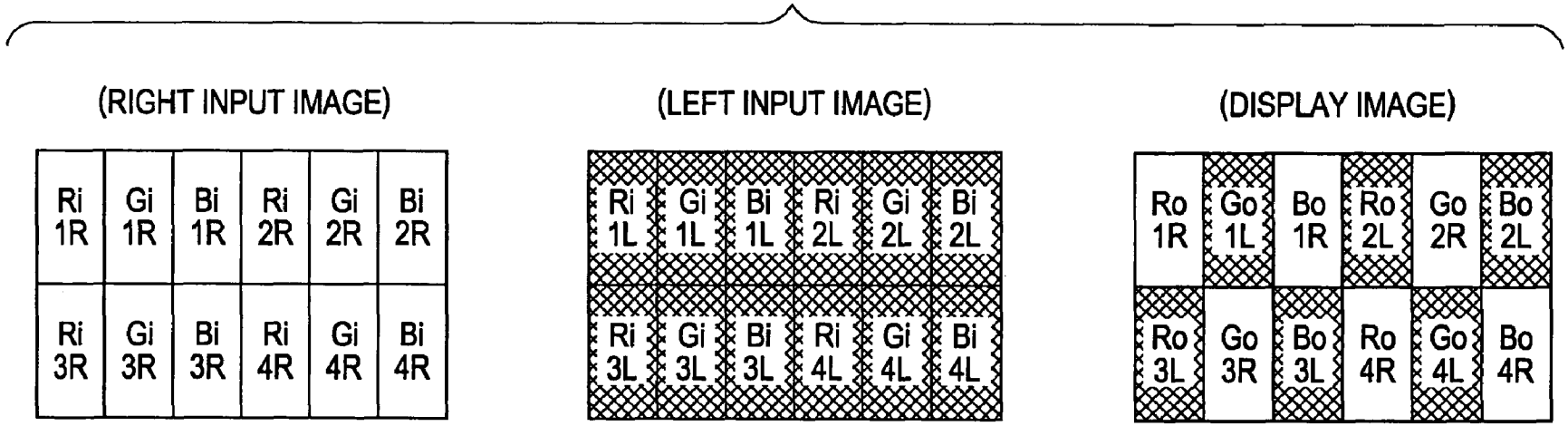

<PROCESSING (Ro1R TO Bo2L)>

$$\left.\begin{aligned} Ro1R &= (1-\alpha)Ri1R+\alpha(Ri3R) \\ Go1L &= (1-\alpha)Gi1L+\alpha(Gi3L) \\ Bo1R &= (1-\alpha)Bi1R+\alpha(Bi3R) \\ Ro2L &= (1-\alpha)Ri2L+\alpha(Ri4L) \\ Go2R &= (1-\alpha)Gi2R+\alpha(Gi4R) \\ Bo2L &= (1-\alpha)Bi2L+\alpha(Bi4L) \end{aligned}\right\} (2\text{-}1)$$

<PROCESSING (Ro3L TO Bo4R)>

$$\left.\begin{aligned} Ro3L &= (1-\alpha)Ri3L+\alpha(Ri1L) \\ Go3R &= (1-\alpha)Gi3R+\alpha(Gi1R) \\ Bo3L &= (1-\alpha)Bi3L+\alpha(Bi1L) \\ Ro4R &= (1-\alpha)Ri4R+\alpha(Ri2R) \\ Go4L &= (1-\alpha)Gi4L+\alpha(Gi2L) \\ Bo4R &= (1-\alpha)Bi4R+\alpha(Bi2R) \end{aligned}\right\} (2\text{-}2)$$

FIG. 7

<THIRD RENDERING METHOD>

(RIGHT INPUT IMAGE)

| | | | | | | | | |
|---|---|---|---|---|---|---|---|---|
| Ri 1R | Gi 1R | Bi 1R | Ri 2R | Gi 2R | Bi 2R | Ri 3R | Gi 3R | Bi 3R |
| Ri 4R | Gi 4R | Bi 4R | Ri 5R | Gi 5R | Bi 5R | Ri 6R | Gi 6R | Bi 6R |

(LEFT INPUT IMAGE)

| | | | | | | | | |
|---|---|---|---|---|---|---|---|---|
| Ri 1L | Gi 1L | Bi 1L | Ri 2L | Gi 2L | Bi 2L | Ri 3L | Gi 3L | Bi 3L |
| Ri 4L | Gi 4L | Bi 4L | Ri 5L | Gi 5L | Bi 5L | Ri 6L | Gi 6L | Bi 6L |

(DISPLAY IMAGE)

| | | | | | | | | |
|---|---|---|---|---|---|---|---|---|
| Ro 1R | Go 1L | Bo 1R | Ro 2L | Go 2R | Bo 2L | Ro 3R | Go 3L | Bo 3R |
| Ro 4L | Go 4R | Bo 4L | Ro 5R | Go 5L | Bo 5R | Ro 6L | Go 6R | Bo 6L |

⟨CENTRAL PORTION PROCESSING (Ro2R TO Bo5L)⟩

$$\left.\begin{aligned}
Ro2L &= (1-\alpha)Ri2L+\alpha(Ri1L+Ri3L)/2\\
Go2R &= (1-\alpha)Gi2R+\alpha(Gi1R+Gi3R)/2\\
Bo2L &= (1-\alpha)Bi2L+\alpha(Bi1L+Bi3L)/2\\
Ro5R &= (1-\alpha)Ri5R+\alpha(Ri4R+Ri6R)/2\\
Go5L &= (1-\alpha)Gi5L+\alpha(Gi4L+Gi6L)/2\\
Bo5R &= (1-\alpha)Bi5R+\alpha(Bi4R+Bi6R)/2
\end{aligned}\right\}(3)$$

FIG. 8

<FOURTH RENDERING METHOD>

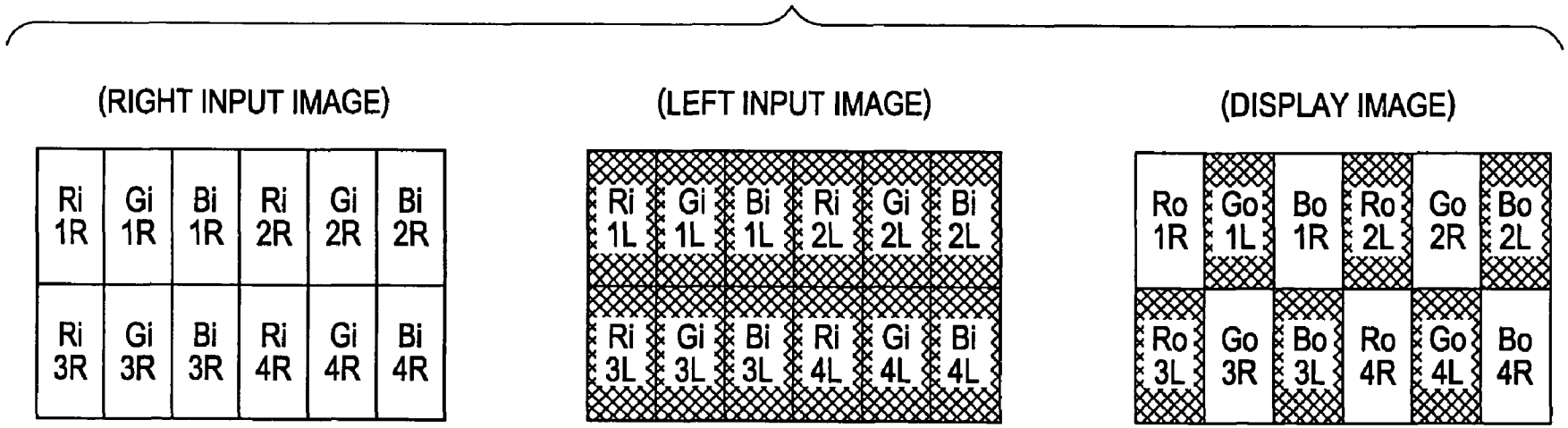

<PROCESSING (Ro1R TO Bo2L)>

$$\left.\begin{aligned} Ro1R &= (1-\alpha)Ri1R+\alpha(Ri2R) \\ Go1L &= (1-\alpha)Gi1L+\alpha(Gi2L) \\ Bo1R &= (1-\alpha)Bi1R+\alpha(Bi2R) \\ Ro2L &= (1-\alpha)Ri2L+\alpha(Ri1L) \\ Go2R &= (1-\alpha)Gi2R+\alpha(Gi1R) \\ Bo2L &= (1-\alpha)Bi2L+\alpha(Bi1L) \end{aligned}\right\} (4-1)$$

<PROCESSING (Ro3L TO Bo4R)>

$$\left.\begin{aligned} Ro3L &= (1-\alpha)Ri3L+\alpha(Ri4L) \\ Go3R &= (1-\alpha)Gi3R+\alpha(Gi4R) \\ Bo3L &= (1-\alpha)Bi3L+\alpha(Bi4L) \\ Ro4R &= (1-\alpha)Ri4R+\alpha(Ri1R) \\ Go4L &= (1-\alpha)Gi4L+\alpha(Gi1L) \\ Bo4R &= (1-\alpha)Bi4R+\alpha(Bi1R) \end{aligned}\right\} (4-2)$$

IMAGE DISPLAY DEVICE AND ELECTRONIC APPARATUS

BACKGROUND

1. Technical Field

The present invention relates to an image display device capable of realizing dual-image display.

2. Related Art

There are known a dual-image display device which displays different images to be viewed by different viewers in different viewing positions and a stereoscopic display device which displays a stereoscopic image. One system for the above-mentioned image display devices is a parallax barrier system. An image display device based on the parallax barrier system includes a liquid crystal display panel and a parallax barrier provided on the viewer side display surface of the liquid crystal display panel. The parallax barrier has some opening portions which are in the form of stripes at predetermined positions. For example, the opening portions of the parallax barrier are disposed in a manner such that a first image is viewed only by a first viewer and a second image is viewed only by a second viewer when different images are provided to different viewer in different viewing positions.

JP-A-2004-140700 and JP-A-2006-276569 disclose dual-image display techniques in which two different images displayed on one display device can be individually viewed by different viewers.

Japanese Patent No 3,096,613 discloses a stereoscopic display device in which pixels for left eye and pixels for right eye are alternately arranged in all rows and columns.

In even the dual-image display device using the parallax barrier or the like, it is possible to display two images by alternately arranging picture elements of one input image and picture elements of another input image in a row direction and a column direction like the display device disclosed in Japanese Patent No. 3,096,613. In this case, in single-image display mode in which the two images input as the input images are the same image, if a viewing direction is misaligned with a direction confronting the display device so as to be shifted to the left side or to the right side from the confronting direction, white lines and white dots look tinted with colors. Hereinafter, this phenomenon is termed "color separation."

SUMMARY

An advantage of some aspects of the invention is that it provides a display device capable of realizing dual-image display with higher resolution and lower color separation.

A first aspect of the invention provides an image display device including a display panel having a plurality of pixel display portions arranged in a longitudinal direction and a lateral direction thereof, a plurality of slits disposed on the display panel so as to correspond to spaces between the pixel display portions adjacent to each other, an image input unit acquiring a first input image and a second input image, and a display control unit displaying the first image and the second image on the display panel in a manner of alternately arranging input pixel data of the first input image and input pixel data of the second input image so as to correspond to the plurality of pixel display portions in the longitudinal direction and the lateral direction, in which the display control unit prepares display pixel data on the basis of specific input pixel data in each of the first input image and the second input image and at least one neighboring input pixel data adjacent to the specific input pixel data in the longitudinal direction or the lateral direction in the corresponding input image.

In the display device, it is preferable that the display panel has a plurality of pixel display portions arranged in the longitudinal direction and the lateral direction. On the display panel, the slits are disposed corresponding to spaces between the pixel display portions adjacent to each other. The input image includes the first input image and the second input image. Each of the first input image and the second input image is comprised of a plurality of input pixel data. Input pixel data constituting the first input image and input pixel data constituting the second input image are alternately arranged on the display panel in the longitudinal direction and the lateral direction. The arrangement is called zigzag arrangement. When the input image for left side is the first input image and the input image for right side is the second input image, a viewer on the left side can see only the input image for left side and a viewer on the right side can see only the input image for right side. With this arrangement, it is possible to realize dual-image display. On the other hand, when the first input image and the second input image are the same image, a single-image display with high resolution can be achieved.

In both the dual-image display mode and the single-image display mode, with respect to each of the first input image and the second input image, it is possible to prepare display pixel data corresponding to specific input pixel data on the basis of the specific input pixel data in one input image and at least one neighboring input pixel data adjacent to the specific pixel data in the longitudinal direction and the lateral direction in the corresponding input image. With such a method, it is possible to inhibit color separation when displaying white lines and/or white dots while avoiding degradation of resolution.

In the image display device, it is preferable that the display control unit prepares the display pixel data by synthesizing specific input pixel data in one input image and the sum of two neighboring input pixel data adjacent to the specific input pixel data in the longitudinal direction in the corresponding input image using a predetermined synthesis coefficient.

In the image display device, it is preferable that the display control unit prepares the display pixel data by synthesizing the specific input pixel data in one input image and one neighboring input pixel data adjacent to the specific input pixel data on the upper side or the lower side of the specific input pixel data in the corresponding input image using a predetermined coefficient.

In the image display device, the display control unit prepares the display pixel data by synthesizing specific input pixel data in one input image and the sum of two neighboring input pixel data adjacent to the specific input pixel data in the lateral direction in the corresponding input image using a predetermined synthesis coefficient.

In the image display device, the display control unit prepares the display pixel data by synthesizing specific input pixel data in one input image and one neighboring input pixel data adjacent to the specific input pixel data on the left side or the right side in the corresponding input image using a predetermined synthesis coefficient.

In the image display device, it is preferable that the predetermined synthesis coefficient is 0.3 or more and less than 0.5. By setting the synthesis coefficient to be in such a range, it is possible to inhibit color separation while avoiding degradation of resolution.

BRIEF DESCRIPTION OF THE DRAWINGS

The invention will be described with reference to the accompanying drawings, wherein like numbers reference like elements.

FIG. 5 is a view for explaining a first rendering method.

FIG. 6 is a view for explaining a second rendering method.

FIG. 7 is a view for explaining a third rendering method.

FIG. 8 is a view for explaining a fourth rendering method.

DESCRIPTION OF EXEMPLARY EMBODIMENTS

Embodiments of the invention will be described below with reference to the accompanying drawings.

Image Display Device

Figure 1:
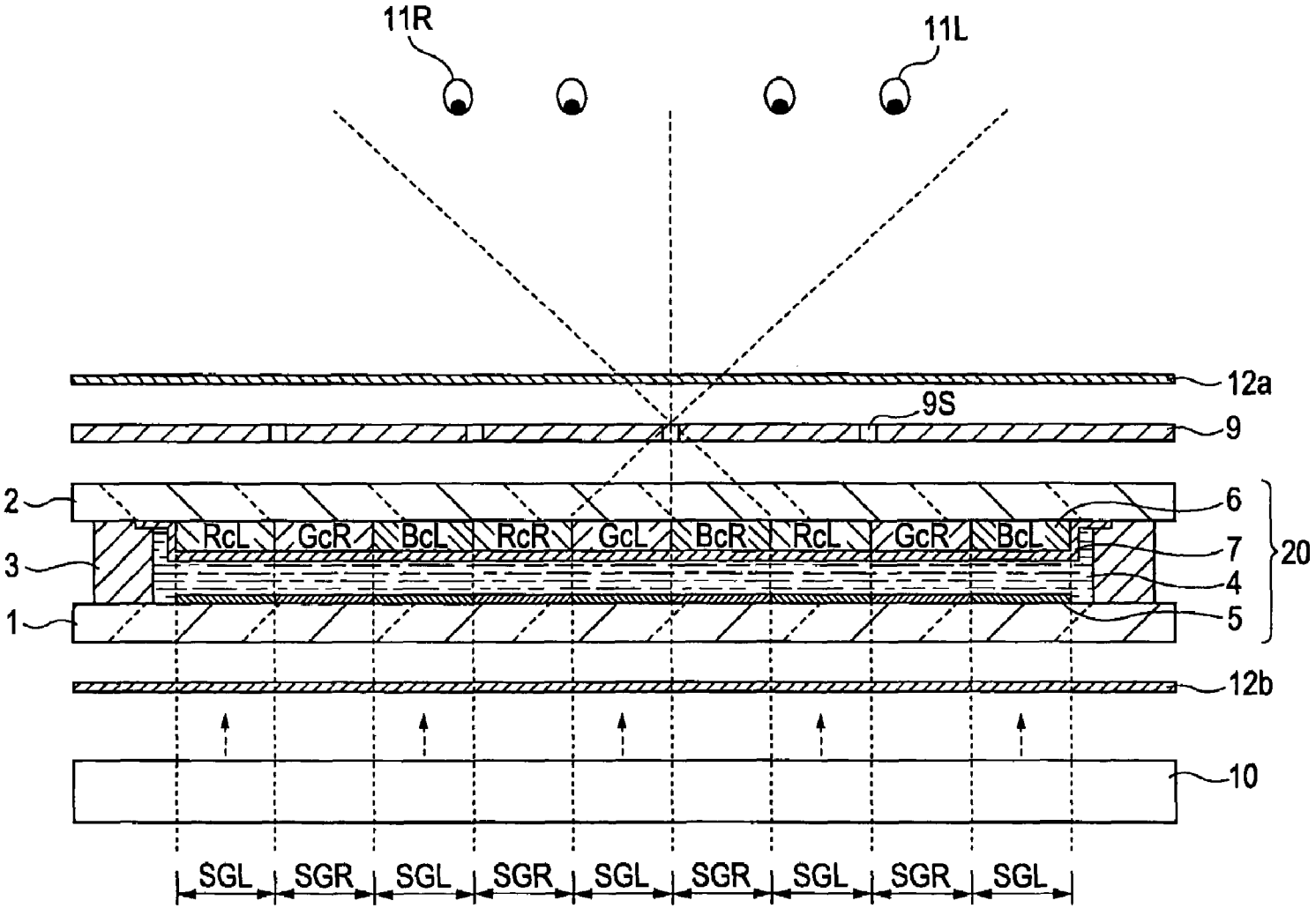
FIG. 1 is a sectional view illustrating an image display device according to one embodiment.

FIG. 1 is a sectional view illustrating an image display device 100 according to one embodiment. The image display device 100 according to this embodiment has a parallax barrier system. Accordingly, the image display device 100 can perform a dual-image display by which different images can be viewed by to a plurality of different viewers in different viewing positions.

As shown in FIG. 1, the image display device 100 according to this embodiment mainly includes a parallax barrier 9, a liquid crystal display panel 20, and a lighting device 10.

The liquid crystal display panel 20 has a structure in which substrates 1 and 2 are attached to each other with a sealing member 3 in between. Liquid crystals 4 are sealed in a gap between the substrates 1 and 2. Pixel electrodes 5 are formed on the substrate 1 so as to correspond to every dot of sub-pixels SGL, SGR and colored layers 6 (color filters) in R, G, and B and an opposing electrode 7 are formed on the substrate 2. The colored layers 6 in R, G, and B are formed corresponding to positions of the pixel electrodes 6. The opposing electrode 7 is formed covering the entire surface of the substrate 2.

The lighting device 10 is disposed on the rear side of the liquid crystal display panel 20. The lighting device 10 illuminates so as to allow light therefrom to pass through the liquid crystal display panel 20. A lower polarizing plate 12*b* is disposed between the liquid crystal display panel 20 and the lighting device 10.

The parallax barrier 9 is arranged on the light exit surface of the liquid crystal panel 20 as an image separating unit. The parallax barrier 9 is a panel with a plurality of slits 9S arranged at predetermined regular intervals. The parallax barrier 9 acts like transmissive regions only at regions in which the slits are provided and also acts like light blocking regions at regions other than the slits. The parallax barrier 9 has a structure in which liquid crystals are interposed between two substrates, and thus the parallax barrier 9 forms the transmissive regions by the slits 9S and the light blocking regions which blocks light by controlling alignment of the liquid crystals. The slits 9S are positioned corresponding to spaces between the colored layers 6 adjacent to each other or between the pixel electrodes 5 adjacent to each other in the liquid crystal display panel 20. An upper polarizing plate 12*a* is arranged on the light exit surface of the parallax barrier 9.

Light emitted from the lighting device 10 impinges on the liquid crystal display panel 20, then penetrates through the colored layers 6, and finally emerges out from the liquid crystal display panel 20. The exit light passed through out the liquid crystal display panel 20 further advances through the slits 9S and reaches a plurality of viewers 11L and 11R situated in different viewing positions.

In the image display device 100 shown in FIG. 1, the colored layers 6 in R, G, and B, through which the light directing toward the viewer 11L passes, are denoted by reference characters RcL, GcL, and BcL, and the colored layers 6 in R, G, and B, through which the light for the viewer 11R passes, are denoted by reference characteristics RcR, GCR, and BCR. Accordingly, the sub-pixels SGL, each having any of the colored layers RcL, GcL, and BcL correspond sub-pixels for R, G, and B in the liquid crystal display panel 20 through which the light for the viewer 11L penetrates and the colored layers RcR, GcR, and BcR correspond to sub-pixels for R, G, and B in the liquid crystal display panel 20 through which light for the viewer 11R penetrates.

For example, as indicated by a short-dashed line, the light penetrated through out the colored layer GcL passes the slit 9S positioned corresponding to a space between the colored layers GcL and BcR, and finally reaches the viewer 11L. On the other hand, the light penetrated through out the colored layer BcR passes the slit 9S, and finally reaches the viewer 11R.

Figure 2:
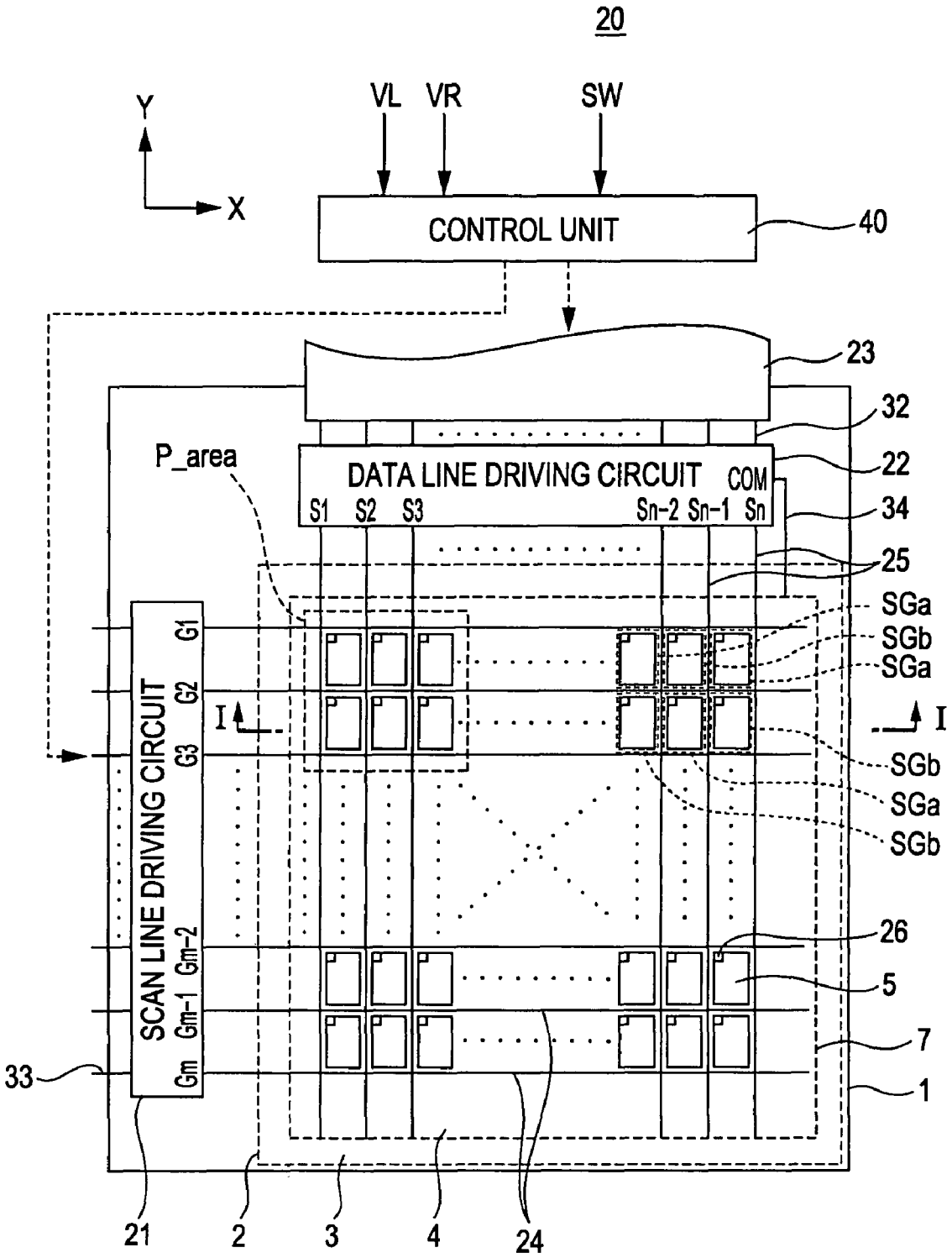
FIG. 2 is a plan view illustrating a liquid crystal display panel of the image display device according to the embodiment.

Hereinafter, the structure of a driving circuit of the liquid crystal display panel 20 will be described. FIG. 2 is a plan view illustrating the liquid crystal display panel 20 of the image display device 100. The sectional view of the liquid crystal display panel 20 of the image display device 100 shown in FIG. 1 is a view taken along line I-I in the plan view of the liquid crystal display panel 20 shown in FIG. 2. With reference to FIG. 2, the longitudinal direction on paper (column direction) is referred to as Y direction and the lateral direction on paper (row direction) is referred to as X direction.

A plurality of scan lines 24 and a plurality of data lines 25 are arranged on the substrate 1 in a matrix form. Each of intersections of the scan lines 24 and the data lines 25S is provided with a switching element 26 such as a thin film transistor (TFT). Pixel electrodes 5 are electrically connected to the switching elements 26.

In greater detail, the substrate 1 has extended portions located outside the substrate 2 and disposed in a manner of protruding from the edge of the substrate 2 in the X direction and the Y direction. A scan line driving circuit 21 is arranged on the extended portion in the X direction and a data line driving circuit 22 is arranged on the extended portion in the Y direction.

Each of data lines 25 denoted by reference characters S1, S2, S3 . . . , Sn (n is a natural number) extends in the Y direction and the data lines 25 are arranged in the X direction at regular intervals. An end of each of the data line 25 is electrically connected to the data line driving circuit 22. The data line driving circuit 22 is electrically to an FPC 23 via a wiring 32. The FPC 23 is electrically connected to an external electronic apparatus. The data line driving circuit 22 receives a control signal from a control unit 40 of the external electronic apparatus via the FPC 23. The data line driving circuit 22 supplies data signals to the data lines denoted by reference characters S1, S2, S3 . . . , Sn on the basis of the control signal.

Each of the scan lines 24 denoted by reference characters G1, G2, G3 . . . , Gm (m is a natural number) extends in the X direction, and the scan lines 24 are arranged in the Y direction at regular intervals. An end of the scan line 24 is electrically connected to the scan line driving circuit 21. The scan line driving circuit 21 is electrically connected to a wiring 33 and the wiring 33 is electrically to the external electronic apparatus. The scan line driving circuit 21 receives a control signal from the control unit 40 of the external electronic apparatus via the wiring 33. The scan line driving circuit 21 sequentially supplies scan signals to the scan lines 24 denoted by reference characters G1, G2, G3 . . . , and Gm on the basis of the control signal.

The opposing electrode 7 is electrically connected to the data line driving circuit 22 via a wiring 34 denoted by reference character COM. The data line driving circuit 22 supplies a driving signal to the opposing electrode 7 via the wiring 34 on the basis of the control signal from the external electronic apparatus, thereby driving the opposing electrode 7.

The scan line driving circuit 21 selectively and exclusively selects the data lines denoted by reference characters G1, G2, G2 . . . , Gm on the basis of the control signal from the control unit 40 and supplies the scan signal to the selected scan line 24. The data line driving circuit 22 supplies the data signals corresponding to display content to the pixel electrodes 5 disposed so as to correspond to the scan lines 24 selected on the basis of the control signal which is output from the control unit 40 via the corresponding data lines 25. By such processing, an electric potential is applied to the pixel electrode 5 and thus liquid crystal molecules in the liquid crystals 4 disposed between the pixel electrodes 5 and the opposing electrode 7 come to be arranged in a display state or a half-ton display state so that it is possible to display a desired image on the liquid crystal display panel 20. That is, the control unit 40 can control the scan signals and the data signals supplied to the plurality of scan lines 24 and the plurality of data lines 25 by supplying the control signal to the scan line driving circuit 21 and the data line driving circuit, and the control unit 40 can display a desired image on the liquid crystal display panel 20.

Sub-pixels SGL by which the left input image is displayed and sub-pixels SGR by which the right input image is displayed are alternately arranged in the X direction and the Y direction. Such sub-pixel arrangement is called zigzag arrangement structure. Accordingly, an image for the viewer 11L is displayed by alignment change of the liquid crystal molecules between the pixel electrodes 5 and the opposing electrode 7 in the sub-pixels SGL and an image for the viewer 11R is displayed by arrangement changer of the liquid crystal molecules between the pixel electrodes and the opposing electrode 7 in the sub-pixels SGR.

A left input image VL for a left side viewer and a right input image VR for a right side viewer which are output from an image source (not shown) are input to the control unit 40. The image display device 100 can be operated in both a dual-image display mode and a single-image display mode. When the image display device 100 is operated in the dual-image display mode, the image display device 100 provides different images to left and right side viewers, respectively. In greater detail, in the dual-image display mode, the left input image LV is viewed by the viewer 11L positioned on the left side of the image display device 100 and the right input image LR is viewed by the viewer 11R positioned on the right side of the image display device 100. On the other hand, in the single-image display mode, a single input image is displayed on the image display device 100. In this case, the left input image and the right input image are the same input image.

Switching of display modes between the dual-image display mode and the single-image display mode is not automatically carried out by the control unit 40 but is manually carried out in a manner such that a user externally inputs a switching signal SW.

Image Display Method

Next, an image display method of the display image device 100 according to an embodiment of the invention will be explained.

Basic Display Method

Figure 3:
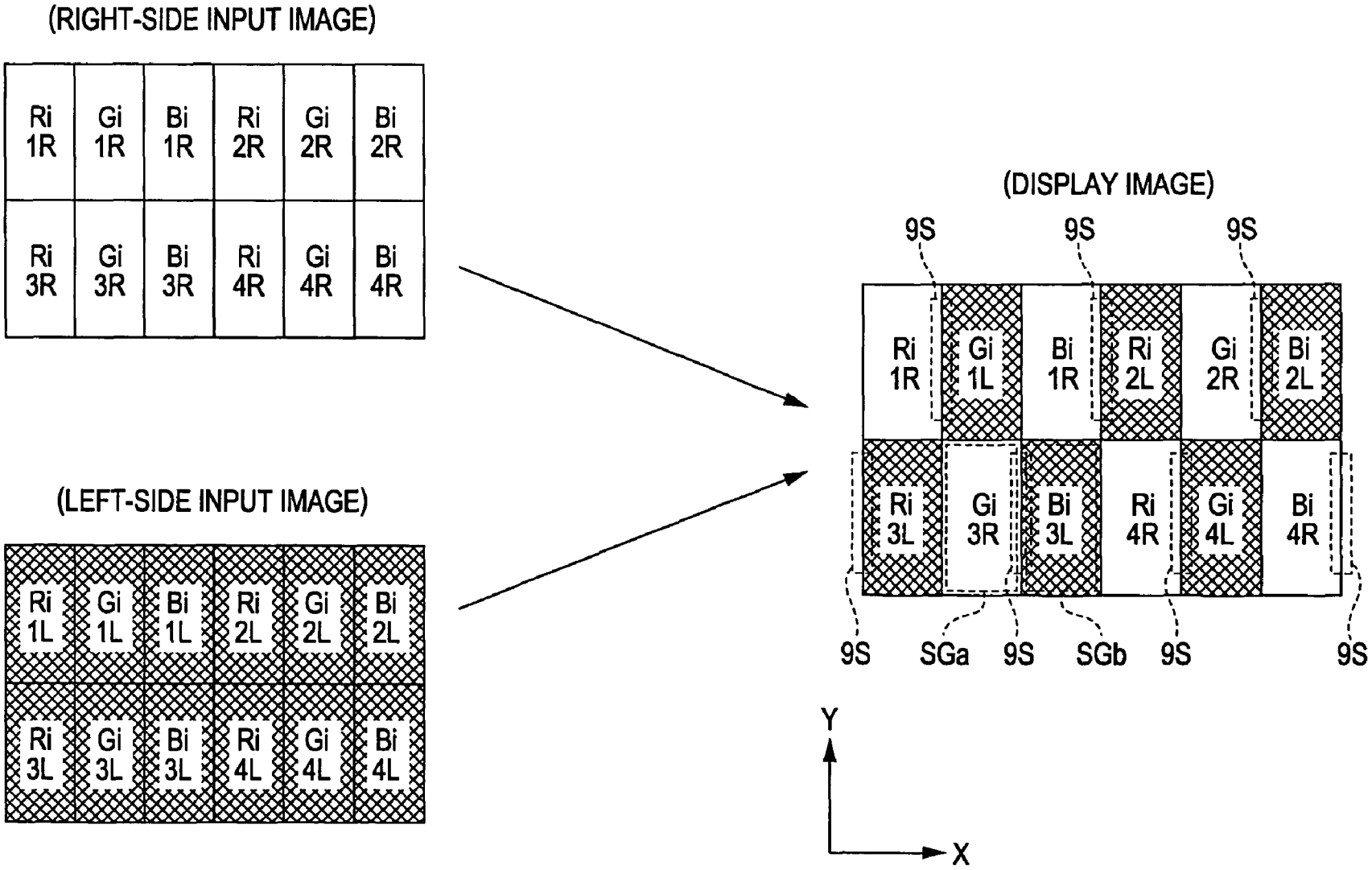
FIG. 3 is a view for explaining a method of preparing a display image in a dual-image display mode.

FIG. 3 schematically shows a method of preparing a display image by synthesizing the left input image and the right input image. The left input image is an image to be viewed by the viewer 11L and the right input image is an image to be viewed by the viewer 11R. The display image is an image produced by synthesizing the left input image and the right input image and is an image displayed on the liquid crystal display panel 20 of the image display device 100.

In an example of FIG. 3, the left input image consists of input pixel data Ri1R to Bi4R. The input pixel data is image data in the unit of sub-pixel. The input pixel data denoted by reference characters Ri, Gi, and Bi mean input pixel data in R, G, and B, respectively. In FIG. 3, the right input image consists of four color pixels, first to fourth color pixels. The first color pixel consists of pixel data Ri1R, Gi1R, and Bi1R, the second color pixel consists of pixel data Ri2R, Gi2R, and Bi2R, the third color pixel consists of pixel data Ri3R, Gi3R, and Bi3R, and the fourth color pixel consists of pixel data Ri4R, Gi4R, and Bi4R. In the same way, the left input image consists of four color pixels, first to fourth color pixels. The first color pixel consists of pixel data Ri1L, Gi1L, and Bi1*l*, the second color pixel consists of pixel data Ri2L, Gi2L, and Bi2L, the third color pixel consists of pixel data Ri3L, Gi3L, and Bi3L, and the fourth color pixel consists of pixel data Ri4L, Gi4L, and Bi4L.

The control unit 40 synthesizes input pixel data of the left input image and input pixel data of the right input image so as to correspond to sub-pixels SGL and sub-pixels SGR, respectively when preparing a display image. That is, as described above, the sub-pixels SGL and the sub-pixels SGR are set so as to be alternately arranged in both the X direction and the Y direction on the liquid crystal display panel 20. Accordingly, the control unit 40 synthesizes the input pixel data of the left input image and the input pixel data of the right input image so as to correspond to the sub-pixels SGL and the sub-pixels SGR.

In greater detail, the control unit 40 alternatively selects the input pixel data of the left input image and the input pixel data of the right input image in the row direction and the column direction and uses the selected input pixel data in order to constitute the display pixel data when preparing the display image using the left input image and the right input image. In an example shown FIG. 3, the input pixel data Ri1R, Bi1R, Gi2R, Gi3R, Ri4R, and Bi4R of the right input image are used in order to constitute the display image. In the same way, the input pixel data Gi1L, Ri2L, Bi2L, Ri3L, Bi3L, and Gi4L of the left input image are used in order to constitute the display image. These selected input pixel data are alternatively arranged in the column direction and the row direction so as to form the display image as shown in FIG. 3.

The control unit 40 determines a potential to be applied to the pixel electrodes 5 of the sub-pixels SGL and the sub-pixels SGR on the basis of gray levels of the input pixel data in the display image prepared in the above-mentioned manner and supplies the determined potential to the scan line driving circuit 21 and the data line driving circuit 22 as the control signal.

In this manner, the display image shown in FIG. 3 is displayed on the liquid crystal display panel 20 of the image display device 100. In the display image shown in FIG. 3, positions of the slits 9S of the parallax barrier 9 is shown by short dashed line. The viewer 11L can see only the display pixel data Gi1L, Ri2L, Bi2L, Ri3L, Bi3L, and Gi4L and recognizes the left input image because he or she sees the display image through the slits 9S. On the other hand, the viewer 11R can see only the display pixel data Ri1R, Bi1R, Gi2R, Gi3R, Ri4R, and Bi4R and recognizes the right input image because he or she sees the display image through the slits 9S.

Color Separation

Next, color separation will be described. In the above basic display method, if the input image includes white dots, there is probability that color separation occurs on the spots of the white dots and thus the white dots in the display image looked color tinted. This event will be explained in greater detail below.

Figure 4:
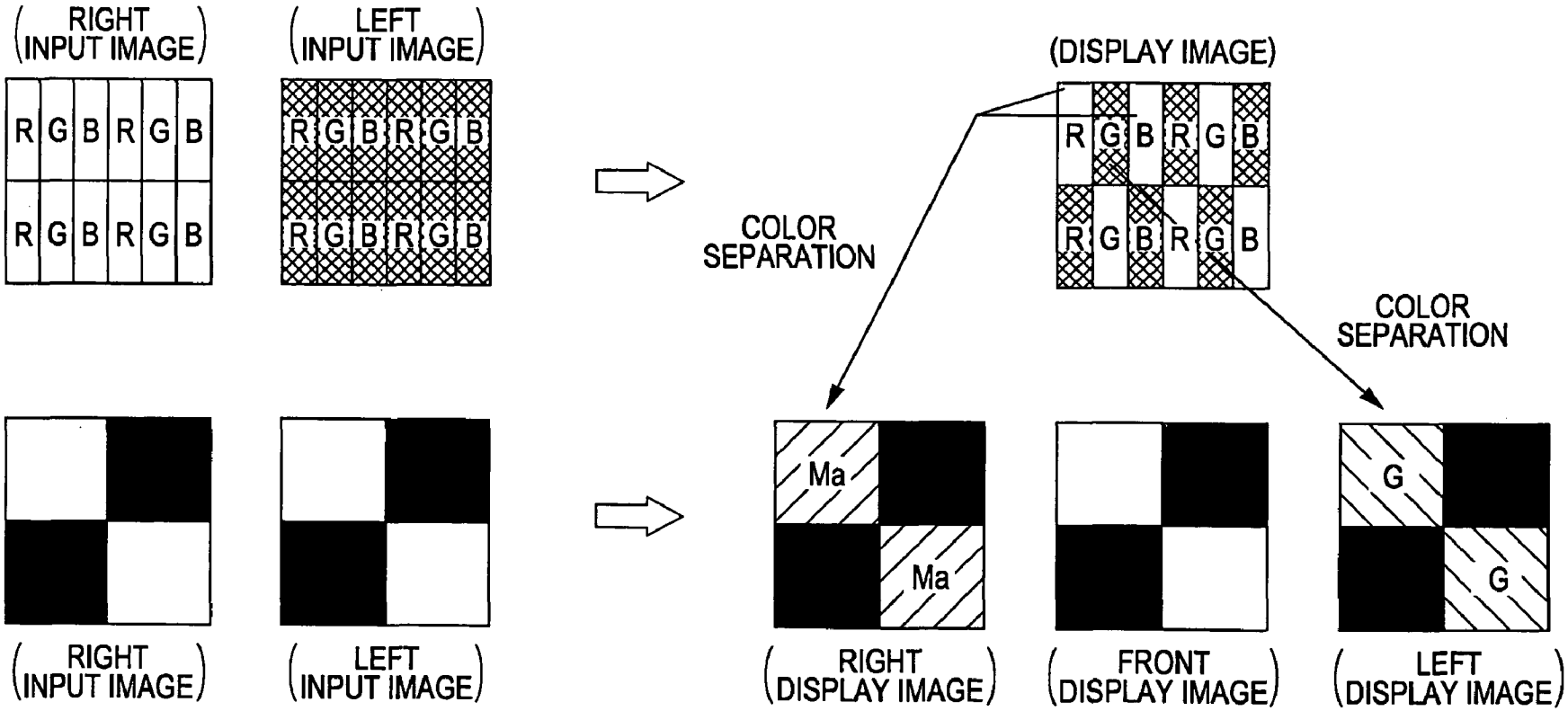
FIG. 4 is a view for explaining color separation in a single-image display mode.

As shown in FIG. 4, there can be a case in which an image consisting of black and white pixels arranged in the longitudinal direction and the lateral direction is input as the left input image and the right input image. In this case, according to the basic display method, as drawn at a right upper portion in FIG. 4, the input pixel data of the input left image and the input pixel data of the right input image are alternately arranged in the longitudinal direction and the lateral direction. When the display image is viewed in a confronting direction of the display panel, it appears that the black and white pixels are correctly arranged as shown in a front view in FIG. 4.

However, as for the white pixels in the display image, the viewer 11R on the right side sees magenta tinted pixels instead of white pixels because the viewer 11R cannot see display pixels other than display pixels in R and B as shown at a right upper portion in FIG. 4. In the same way, the viewer 11L on the left side sees green tinted pixels instead of white pixels because the viewer 11L cannot see display pixels other than the display pixels in G. In such a manner, in the case in which white lines or white dots are displayed, color separation in which white portions looked color tinted occurs. In the basic display method, the color separation is attributable to a problem in which only half each the input pixel data of each input image is used. Accordingly, it is possible to inhibit color separation by a rendering method using adjacent pixel data which are not used.

Accordingly, in this embodiment, each of display pixel data of each color is prepared by synthesizing original input pixel data positioned corresponding to the display pixel data and at least one neighboring input pixel data adjacent to the original input pixel data on the upper or lower side thereof or on the left or right side thereof. Hereinafter, a first rending method to a fourth rendering method will be described. The image display device 100 of the invention can display an image in both the dual-image display mode in which the left input image and the right input image are different images and in the single-image display mode in which the left input image and the right input image are the same image by any of the first to fourth rendering methods.

First Rendering Method

FIG. 5 shows the first rending method. In an example shown in FIG. 5, for convenience's sake of explanation, it is assumed that a left input image consists of six color pixels and a right input image consists of six color pixels. Each color pixel consists of three input pixel data in R, G, and B.

In the first rendering method, the display pixel data is prepared by synthesizing an object input pixel data and the sum of two neighboring input pixel data adjacent to the object input pixel data on the upper side and the lower side thereof using a predetermined synthesis coefficient $\alpha$. For example, display image data Ro3L for left side is obtained based on the following expression.

Ro3L=$(1-\alpha)$ Ri3L+$\alpha$(Ri1L+Ri5L)/2. That is, the display pixel Ro3L is prepared by synthesizing input pixel data Ri3L positioned corresponding to the display pixel data Ro3L and the sum of input pixel data Ri1L adjacent to the input pixel data Ri3L on the upper side and input pixel data Ri5L adjacent to the input pixel data Ri3L on the lower side using a synthesis coefficient $\alpha$.

In the same manner, display pixel data Go3R for right side is obtained based on the following expression.

Go3R=$(1-\alpha)$Gi3R+$\alpha$(Gi1R+Gi5R)/2. That is, the display pixel data Go3R is prepared by synthesizing input pixel data Gi3R positioned corresponding to the display pixel data Go3R and the sum of input pixel data Gi1R adjacent to the input pixel data Gi2R on the upper side and the input pixel data Gi5R adjacent to the input pixel data Gi3R on the lower side using a synthesis coefficient $\alpha$.

However, in the case in which the object input pixel data is positioned at the edge of the input image data, there is no neighboring input pixel data on the upper side or on the lower side of the object input pixel data. In such a case, only one neighboring input pixel data is synthesized with the object input pixel data in order to prepare the display pixel data. In FIG. 5, a display pixel data preparation expression applied to the case in which the object pixel data is positioned at a center portion of the input image data (or not positioned at the edge of the input image data) is referenced by 1-1, and the display pixel data preparing expressions applied to the case in which the object pixel data is positioned at the edge of the input image data are referenced by 1-2 and 1-3.

Here, the synthesis coefficient $\alpha$ is explained. As understood from the above expressions, in the case in which the synthesis coefficient $\alpha$ is zero (0), the display pixel data is the same as the input pixel data positioned corresponding to the display pixel data. Accordingly, when the synthesis coefficient $\alpha$ is zero (0), the color separation occurs. On the other hand, when the synthesis coefficient is 0.5, the display pixel data is prepared by synthesizing a half the neighboring input pixel data adjacent to the input pixel data positioned corresponding to the display pixel data and the input pixel data. This case is equivalent to the case of performing smoothing filter. Accordingly, this case reduces color separation but degrades resolution. For example, in the case in which black and white strips are displayed in the unit of a line, a gray image is formed as a whole due to the smoothing effect. For the above-mentioned reason, it is preferable that the synthesis coefficient $\alpha$ is set to be in the range expressed by $0<\alpha<0.5$.

In the result of experiment performed by the inventor, it is found that optimum value of the synthesis coefficient $\alpha$ is about 0.4. As described above, the optimum value of the synthesis coefficient $\alpha$ is 0.5 from the viewpoint of preventing color separation from occurring. However, since human visual sensitivity with respect to color images is lower than that with respect to a gray image (a black and white image), the color separation can be sufficiently reduced with value 0.4 of the synthesis coefficient. With value 0.4 of the synthesis coefficient, it is also possible to suppress degradation of resolution. Accordingly, it is preferable that the synthesis coefficient is set to be in the range expressed by $0.3\leqq\alpha<0.5$, and 0.4 is the optimum value for the synthesis coefficient. The synthesis coefficient can be different or the same for R. G, and B.

Second Rendering Method

FIG. 6 shows the second rendering method. In FIG. 6, for convenience's sake of explanation, a left input image consists of four color pixels and a right input image consists of four color pixels. Each color pixel consists of three input pixel data in R, G, and B.

According to the second rendering method, the display pixel data is prepared by synthesizing a specific input pixel data and a neighboring input pixel data adjacent to the specific input pixel data on the lower side using the synthesis coefficient. For example, display image data Ro1R for right side is obtained on the basis of the following expression.

Ro1R=(1−α)Ri1R+α(Ri3R). That is, the display pixel data Ro1R is prepared by synthesizing input pixel data Ri1R positioned corresponding to the display pixel data Ro1R and neighboring input pixel data Ri3R adjacent to the input pixel data Ri1R on the lower side using a synthesis coefficient.

In the same way, other display pixel data are also prepared by synthesizing corresponding input pixel data and their neighboring input pixel data adjacent to the corresponding input pixel data on the lower side using the synthesis coefficient α. In FIG. 6, a display pixel preparation expression used for preparing display pixel data on an upper bunk in the display image is referenced by 2-1 and a display pixel preparation expression used for preparing display pixel data on a lower bunk in the display image is referenced by 2-2.

In the above-mentioned example, the display pixel data is prepared by synthesizing the corresponding input pixel data and neighboring input pixel data adjacent to the corresponding input pixel data on the lower side using the synthesis coefficient. However, the display pixel data may be prepared by synthesizing the corresponding input pixel data and neighboring input pixel data adjacent to the corresponding input pixel data on the upper side using the synthesis coefficient α.

In the second rendering method, the synthesis coefficient is set in the same range as in the first rendering method.

Third Rendering Method

FIG. 7 shows the third rendering method. In an example of FIG. 7, for convenience's sake of explanation, a left input image consists of six color pixels and a right input image consists of six color pixels. Each color pixel consists of three input pixel data in R, G, and B.

In the third rendering method, display pixel data prepared by synthesizing a specific input pixel data and two neighboring input pixel data adjacent to the specific input pixel data on the left side and right side using a synthesis coefficient. For example, display pixel data Ro2L for left side is obtained based on the following expression.

Ro2L=(1−α)Ri2L+α(Ri1L+Ri3L)/2. That is, the display pixel data Ro2L is prepared by synthesizing input pixel data Ri2L positioned corresponding to the display pixel data Ro2L and the sum of neighboring input pixel data adjacent to the input pixel data Ri2L on the left side and the right side, respectively, using a synthesis coefficient α.

In this manner, each of other display pixel data is prepared by synthesizing corresponding input pixel data and the sum of two neighboring input pixel data adjacent to the corresponding input pixel data on the left side and the right side using a synthesis coefficient α. In FIG. 7, a display pixel data preparation expression used for preparing display pixel data in a center portion in a display image is referenced by 3. In the third rendering method, in the case in which the input pixel data is positioned at the edge of the input image data, there is no neighboring input pixel data adjacent to the input pixel data on the left side or the right side. In this case, the display pixel data is prepared by synthesizing the input pixel data at the edge of the input image data and one neighboring input pixel data using the above-mentioned synthesis coefficient. The way of thinking in this method is the same as in the first rendering method. Accordingly, explanation of detail calculation is omitted.

In the third rendering method, the synthesis coefficient is set in the same range as in the first rendering method.

Fourth Rendering Method

FIG. 8 shows the fourth rendering method. In FIG. 8, for convenience's sake of explanation, a left input image consists of four color pixels and a right input image consists of four color pixels. Each color pixel consists of three input pixel data in R, G, and B.

In the fourth rendering method, display pixel data is prepared by synthesizing specific input pixel data and one neighboring input pixel data adjacent to the specific input pixel data on the right side using a synthesis coefficient α. For example, display pixel data Ro1R for right side is obtained based on the following expression.

Ro1R=(1−α)Ri1R+α(Ri2R). That is, the display pixel data Ro1R is prepared by synthesizing input pixel data Ri1R positioned corresponding to the display pixel data Ro1R and neighboring input pixel data Ri2R adjacent to the input pixel data Ri1R on the right side using a synthesis coefficient α.

In the same way, each of other display pixel data is prepared by synthesizing corresponding input pixel data and neighboring input pixel data adjacent to the corresponding input pixel data on the right side using the synthesis coefficient. In FIG. 8, a display pixel data preparation expression used for preparing display pixel data in an upper bunk of a display image is referenced by 4-1 and a display pixel data preparation expression used for preparing display pixel data in a lower bunk of a display image is referenced by 4-2.

In the above-mentioned example, each of the display pixel data is prepared by synthesizing the corresponding input pixel data and neighboring input pixel data adjacent to the corresponding input pixel data on the right side. However, each of the display pixel data may be prepared by synthesizing the corresponding input pixel data and neighboring input pixel data adjacent to the corresponding input pixel data on the left side.

In the fourth rendering method, the synthesis coefficient can be set in the same range as in the first embodiment.

As described above, in the single-image display mode, it is possible to inhibit color separation avoiding degradation of resolution of a display image by using any of the first to fourth rendering methods using a proper synthesis coefficient.

Display Processing

Figure 9:
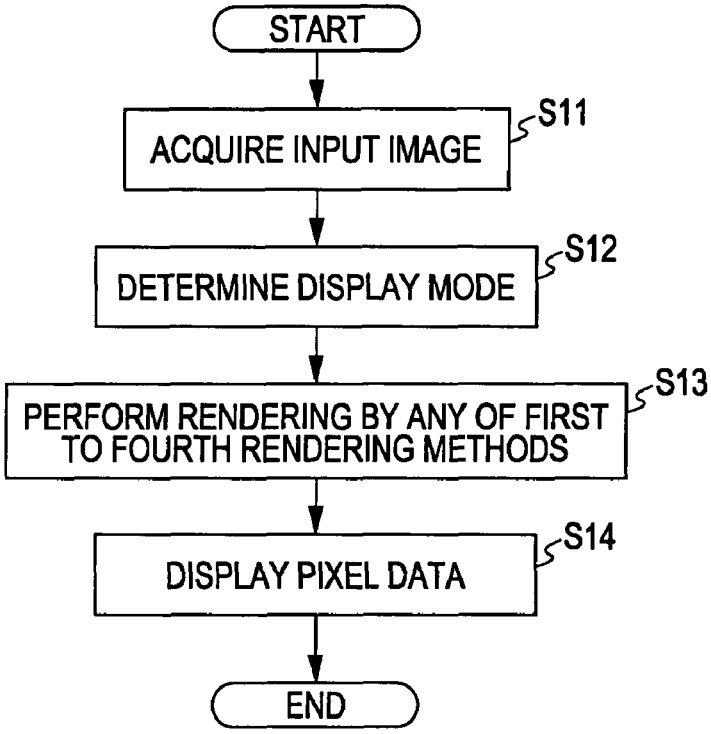
FIG. 9 is a flowchart illustrating image processing sequence.

FIG. 9 is a flowchart showing sequence of display processing in the image display device 100. First, the control unit 40 acquires the left input image data VL and the right input image data VR (Step S11). Next, a display mode is determined (Step S12). In greater detail, the control unit 40 determines which of the single-image display mode and the dual-image display mode is selected. Next, the control unit 40 prepares display pixel data constituting a display image using any of the first to fourth rendering method using the left image and the right image according to either the single-image display mode or the dual-image display mode which is selected in Step S12 (Step S13). Finally, each of the display pixel data is displayed on the liquid crystal display panel 20 (Step S14).

Electronic Apparatus

Figure 10:
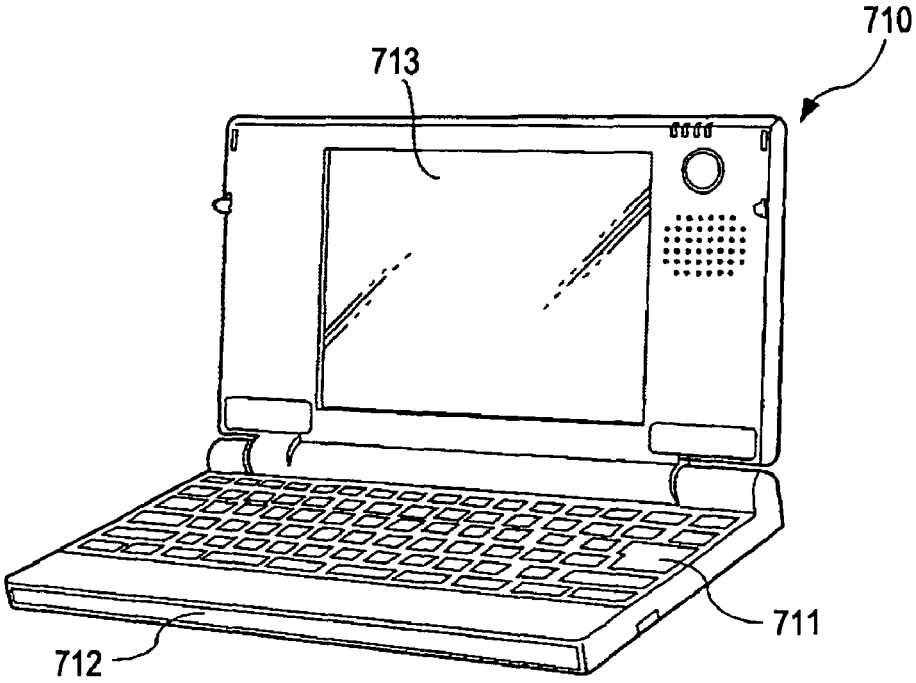
FIG. 10 is an electronic apparatus to which the image displaying device of the invention is applied.

Next, electronic apparatuses to which the image display device 100 according to the above embodiments can be applied will be exemplified with reference to FIG. 10.

A first example is a portable personal computer (called notebook computer) in which the image display device 100 according to the embodiment is applied to a display unit. FIG. 10 perspectively shows the structure of the portable personal computer. As shown in FIG. 10, the portable personal computer 10 includes a body unit including a keyboard 711 and a display unit 713 to which the image display device 100 according to the invention is applied.

It is preferable that the image display device 100 according to each of the embodiments is applied to a display unit of a liquid crystal television set or a car navigation device. For example, when the image display device 100 according to the embodiment is applied to the display unit of the car navigation device, it is possible to provide a map to a viewer on a driver's seat and a movie to a viewer on a passenger's seat by the car navigation device.

Other examples of an electronic apparatus to which the image display device 100 according to each of the embodiments can be applied include a viewfinder type or monitor type video recorder, a pager, an electronic organizer, a calculator, a cellular phone, a word processor, a workstation, a videoconferencing phone, a POS terminal, a digital still camera, or the like.

The entire disclosure of Japanese Patent Application No. 2007-038911, filed Feb. 20, 2007 is expressly incorporated by reference herein.

What is claimed is:

1. Image display device, comprising:

a display panel having a plurality of pixel display portions arranged in a longitudinal direction and a lateral direction thereof;

a plurality of slits arranged on the display panel so as to correspond to spaces between the pixel display portions adjacent to each other;

an image input unit acquiring a first input image and a second input image; and a display control portion displaying the first input image and the second input image by alternately imparting input pixel data of the first input image and input pixel data of the second input image to the plurality of pixel display portions in the longitudinal direction and the lateral direction, wherein, the display control portion prepares display pixel data corresponding to specific input pixel data on the basis of the specific input pixel data of each of the first input image and second input image and at least one neighboring input pixel data adjacent to the specific input pixel data in the longitudinal direction or the lateral direction in the corresponding input image using a predetermined synthesis coefficient.

2. The image display device according to claim 1, wherein the display control unit prepares the display pixel data by synthesizing the specific input pixel data and the sum of two neighboring input pixel data adjacent to the specific input pixel data in the longitudinal direction using the predetermined synthesis coefficient.

3. The image display device according to claim 1, wherein the display control unit prepares the display pixel data by synthesizing the specific input pixel data and one neighboring input pixel data adjacent to the specific input pixel data on the upper side or on the lower side in the corresponding input image using the predetermined synthesis coefficient.

4. The image display device according to claim 1, wherein the display control unit prepares the display pixel data by synthesizing the specific input pixel data and the sum of two neighboring input pixel data adjacent to the specific input pixel data in the lateral direction in the corresponding input image.

5. The image display device according to claim 1, wherein the display control unit prepares the display pixel data by synthesizing the specific input pixel data and one neighboring input pixel data adjacent to the specific input pixel data on the left side or on the right side in the corresponding input image using a predetermined synthesis coefficient.

6. The image display device according to claim 1, wherein the synthesis coefficient is 0.3 or more and less than 0.5.

7. An electronic apparatus comprising the image display device according to claim 1.

* * * * *